US005263523A

United States Patent [19]

Scheunemann

[11] Patent Number: 5,263,523

[45] Date of Patent: Nov. 23, 1993

[54] MULTI-CARD ELEMENT FOR A BILLFOLD

[75] Inventor: Roy Scheunemann, West Bend, Wis.

[73] Assignee: Amity Leather Products Company, West Bend, Wis.

[21] Appl. No.: 906,549

[22] Filed: Jun. 30, 1992

[51] Int. Cl.[5] ..... A45C 1/06

[52] U.S. Cl. ..... 150/132; 150/147; 40/124.1; 40/405

[58] Field of Search ..... 150/132, 138, 147; 40/159, 124.1, 373, 405

[56] References Cited

U.S. PATENT DOCUMENTS

| | | | |
|---|---|---|---|
| 737,232 | 8/1903 | Heeley et al. . | |
| 1,896,573 | 3/1930 | Buxton . | |
| 1,909,807 | 4/1930 | Buxton . | |
| 2,665,808 | 9/1953 | McAlister | 206/73 |
| 2,959,879 | 11/1960 | Mazur | 40/159 X |
| 3,067,792 | 5/1961 | Broughton | 150/39 |
| 3,146,816 | 11/1959 | Osher | 150/39 |
| 3,280,820 | 2/1964 | Miller | 129/20 |
| 3,392,771 | 3/1967 | Hartley | 150/39 |
| 3,659,640 | 5/1972 | Fenster et al. | 150/35 |
| 3,777,795 | 12/1973 | Graetz | 150/35 |
| 3,856,063 | 12/1974 | Dengel | 150/132 |
| 4,008,742 | 2/1977 | Lemler | 150/147 |
| 4,055,010 | 10/1977 | Fridlund et al. | 150/147 X |
| 4,105,057 | 8/1978 | Baumann et al. | 150/147 X |
| 4,247,999 | 2/1981 | Latino | 40/159 X |
| 4,342,350 | 8/1982 | Resnick | 150/138 |
| 4,589,544 | 5/1986 | Schweinsberg | 206/45 |
| 4,921,027 | 5/1990 | Scheunemann | 40/124.2 X |
| 4,966,210 | 10/1990 | Folkertsma | 150/147 X |

*Primary Examiner*—Allan N. Shoap
*Assistant Examiner*—Christopher McDonald
*Attorney, Agent, or Firm*—Fitch, Even, Tabin & Flannery

[57] ABSTRACT

The present invention is directed to a multi-card element for attachment to a wallet. The multi-card element includes a generally rectangular front wall and a generally rectangular back wall of the same width as the front wall. The front wall and back wall are secured on at least their side edges to form an enclosure. The front wall has a plurality of parallel and spaced apart slits cut therein for reception of a card. A pocket liner is disposed within the enclosure formed by the front wall and the back wall. The pocket liner comprises an elongated generally rectangular back member having a width less than the width of the front and back walls. The back member is secured at its top edge within the enclosure. A plurality of generally rectangular card supporting members is affixed at their lower edge to the back member. The card support members are spaced along the back member in a position such that the top edge of each respective card support member is in alignment with the bottom edge of a slit preceding from top to bottom for each slit, respectively. The top edge of each card support member is affixed to the back of the front wall to provide a series of card supporting chambers for the reception of cards. The card support chambers are defined by the back of the card support member and the front of the back member of the pocket liner.

15 Claims, 3 Drawing Sheets

MULTI-CARD ELEMENT FOR A BILLFOLD

FIELD OF THE INVENTION

The present invention relates to multiple card wallets or billfolds wherein the cards are held in overlapping, shingled relationship so as to be easily accessible for selective withdrawal of a card. More particularly, the present invention is directed to a multi-card element for use in the manufacture of a billfold to provide a multi-card billfold for holding cards in overlapping, shingled relationship.

BACKGROUND OF THE INVENTION

Multiple card wallets or billfolds are known wherein the cards are held in overlapping, shingled relationship. Such prior art multiple card billfolds have usually been constructed to as to provide integral pockets for receiving the credit card. Such prior art multi-card billfolds were very time consuming to assemble and secure together. For example, one prior art type of multi-card billfold utilized separate pockets wherein the pockets were individually assembled in respect to one another and were then hand glued or pasted.

One improved form of multi-card billfold is disclosed in U.S. Pat. No. 3,856,063 to Dengel. In the Dengel patent, a liner for use in assembling a multi-pocket billfold is described. The liner comprises a plastic backing sheet which can be heat-sealed. Pockets are formed in the liner through use of a series of overlying plastic members which are tacked, stitched or heat-sealed around three edges to provide open ended, completely closed off pockets for receiving cards. The Dengel patent solved many problems in respect to ease of assembly of multi-card billfolds, however, it would be desirable to further reduce the amount of material and labor required to manufacture multi-card billfolds.

Accordingly, it is a principal object of the present invention to provide a billfold which utilizes a multi-card liner which is easy to assemble and which reduces the amount of materials and the amount of time required to affect such assembly.

SUMMARY OF THE INVENTION

The present invention provides a billfold, wallet or the like for carrying a plurality of cards, such as credit cards, in shingled and partially exposed relationship to one another whereby a desired card can be readily selected and withdrawn.

More particularly, the present invention is directed to a multi-card element for attachment to a wallet. The multi-card element includes a generally rectangular front wall and a generally rectangular back wall of the same width as the front wall. The front wall and back wall are secured on at least their side edges to form an enclosure The front wall has a plurality of parallel and spaced apart slits cut therein for reception of a card. A pocket liner is disposed within the enclosure formed by the front wall and the back wall. The pocket liner comprises an elongated generally rectangular back member having a width less than the width of the front and back walls. The back member is secured at its top edge within the enclosure. A plurality of generally rectangular card supporting members is affixed at their lower edge to the back member. The card support members are spaced along the back member in a position such that the top edge of each respective card support member is in alignment with the bottom edge of a slit preceding from top to bottom for each slit, respectively The top edge of each card support member is affixed to the back of the front wall to provide a series of card supporting chambers for the reception of cards. The card support chambers are defined by the back of the card support member and the front of the back member of the pocket liner.

Figure 1:
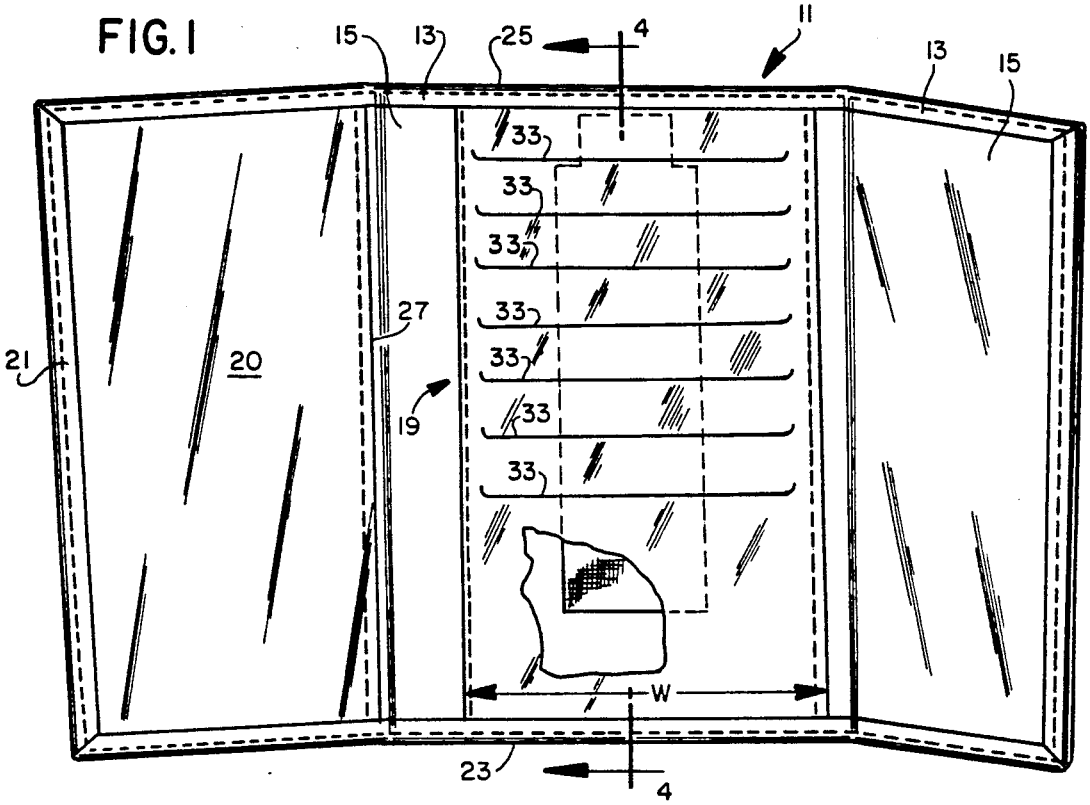
FIG. 1 is a perspective view, partially broken away, of a billfold embodying the present invention, the view being taken generally from the inside of the billfold in an open position.

As used herein, the terms "back", "front", "bottom", "top", "left" and "right" are in reference to the orientation of the wallet shown in FIG. 1.

DETAILED DESCRIPTION OF THE INVENTION

The invention is shown in FIG. 1 as embodied in a fold-up type billfold 11 which is made generally from a flexible material, for example, leather. The billfold 11 includes an outside flexible wall 13 shown folded over a fabric liner 15. Shown disposed within the billfold 11 is the multi-card element 19 of the invention. The usual edging and stitching is provided around the periphery to bind the billfold together More specifically, the edging and stitching binds the outside flexible wall 13 and its fabric liner 15 together and also binds suitable wallet accessories, such as checkbook carrying pocket 20, which is bound to the wallet, but on the left vertical side 21.

The multi-card element 19 is bound to the outer flexible wall 13 and fabric 15 by the stitching along the bottom side 23 and top side 25 of the billfold An open edge 27 is provided behind the checkbook carrying pocket 20 for insertion of the back cover of a checkbook.

Figure 4:
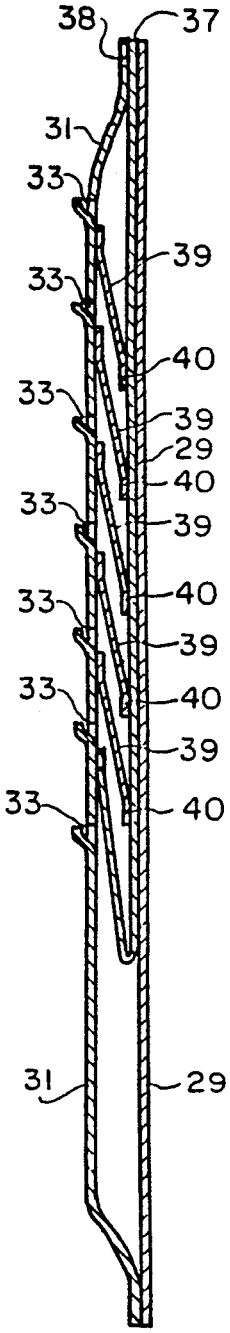
FIG. 4 is a side view, partially broken away, of the assembled multi-card element of the invention, taken along line 4—4 of FIG. 1.

As best seen in FIG. 4, the multi-card element of the present invention includes a back wall 29 and a front wall 31. Each of the back wall 29 and front wall 31 are generally rectangular and have a width W. A plurality of parallel and spaced apart slits 33 are cut in the front wall for reception of cards in shingled relationship The side edges of the front wall and back wall are secured by stitching or other suitable means to form an open ended enclosure. A pocket liner is disposed within the enclosure. The pocket liner includes a generally rectangular back member 29 having a width less than the width W of the back wall 29 and front wall 31. In general, the width of the pocket liner is from about 40% to about 90% of the width of the slits 33. The slits 33, in turn, are preferably at least about 90% of the width W of the back wall 29 and front wall 31. The pocket liner includes a back member 35. The back member 35 is secured at its top edge 37 within the pocket. The top edge 37 of the back member 35 is disposed along the top edge 38 of the back wall 29 and front wall 31.

Figure 2:
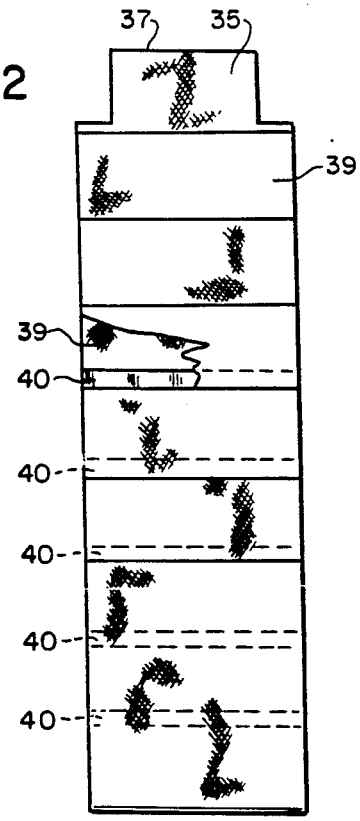
FIG. 2 is a front view of the pocket liner of the invention.
Figure 3:
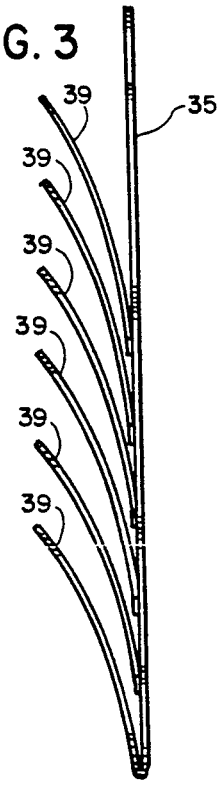
FIG. 3 is a side view of FIG. 2.

As best seen in FIGS. 2 and 3, the pocket liner 26 has a plurality of generally rectangular, parallel and spaced apart card support members 39 affixed at their lower edge to the back member 35 by a suitable method, such as by heat sealing or gluing. Heat seal lines 40 are shown by dotted lines in FIG. 2. The card support members 39 are spaced along the back member in a position such that the top edge of each respective card support member 39 is in alignment with the bottom edge of a slit 33 proceeding from top to bottom for each slit, respectively. As shown in FIG. 3, in one embodiment of the invention, the bottom end of the back member 35 is turned back on itself for a distance sufficient to form the bottom most one of the card support members 39. In this embodiment, the back wall 29 and front wall 31 comprise the pocket for insertion of a card. The top edge of each card support member is affixed to the back of the front wall in a region immediately below the slit 33.

Figure 5:
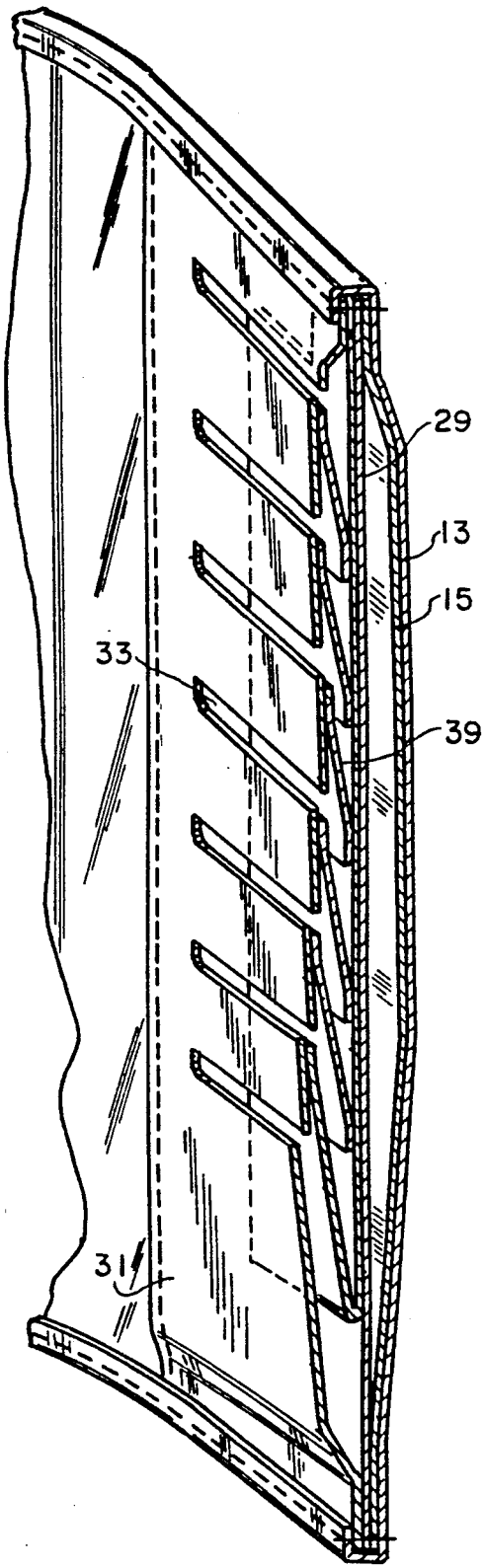
FIG. 5 is a side perspective view of the wallet taken along line 4—4 of FIG. 1.

The pocket liner is preferably centered along the length of the slits 33. As can be seen in FIG. 5, since the width of the pocket liner is less than the width of the slit, an open region exists between the card carrying support member 39 and the edge of the back wall 29 and front wall 31. It has been determined that this open region can be up to about 30% of the width of the slit on each side of the pocket liner without incurring any instability when a card is inserted into the slit and placed in contact with the attachment point of the card support member 39.

Figure 6:
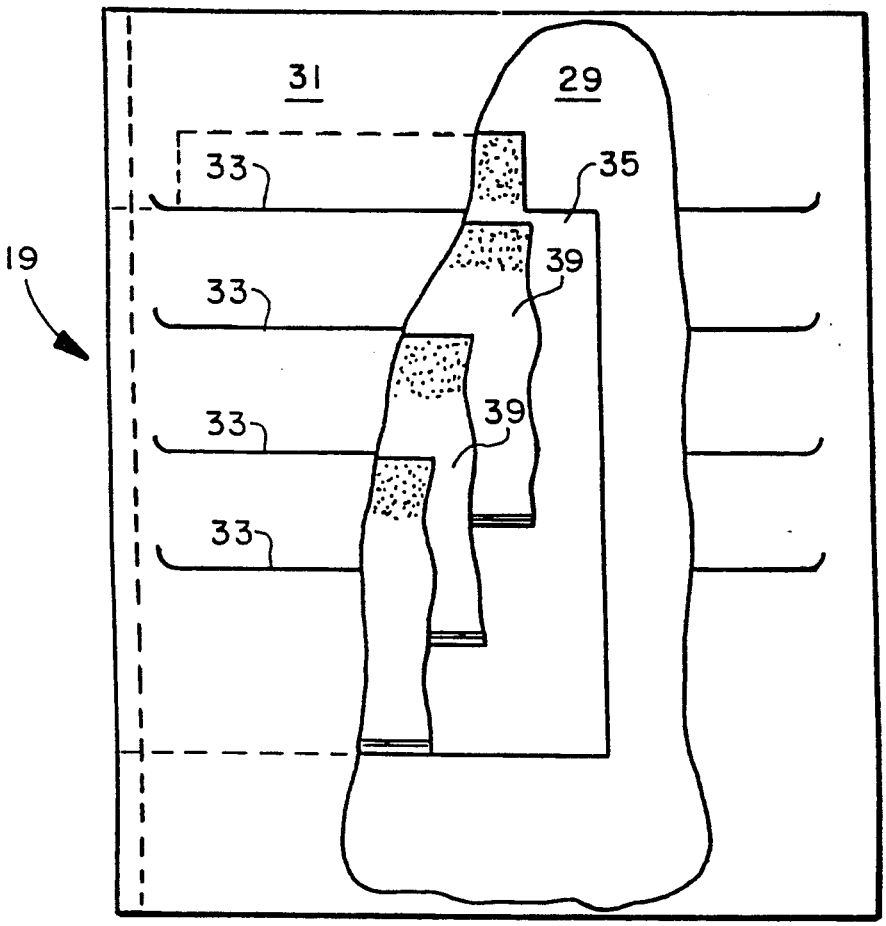
FIG. 6 is a front view, partially broken away of a further embodiment of the present invention.

In a further embodiment of the invention, as shown in FIG. 6, it has been determined that if the width of the pocket liner is at least about 45% of the width W, then the pocket liner can be secured between said front wall and said back wall forming said enclosure on either the right side or left side of the enclosure. The width of the pocket liner in this embodiment will be from about 45% to about 75% of the width W. The pocket liner can then be secured between the front wall and the back wall by the same securing means, such as stitching, that are used to form the open ended enclosure. In this embodiment, it is only necessary to secure the single edges of the front wall and back wall between which the pocket liner has been placed The outer edges of the enclosure can then be secured at the time of assembling the wallet or billfold.

The back wall 29 is not essential for the multi-card element of the invention. Since the pocket liner 26, however, does not extend across the full width of the multi-card element 17 an open space would be observed when the slit 33 is pulled outward. The back wall 29 covers the back of the multi-card element 19 for aesthetic purposes.

While the multi-card element 19 has been described in reference to a fold-up single walled billfold, the multi-card element 19 of the invention is equally suitable for a wallet having an inner and outer flexible wall secured together on three sides to form an envelope-like opening.

In assembling the billfold incorporating a multi-card element 19 of the invention, the top and bottom edges of the multi-card element, unless previously stitched, are inserted under the top edging and bottom edging of the outer flexible wall 13 and are stitched into placed at the same time that the top and bottom edge of the outer flexible wall 13 and liner 15 are stitched. If the top and bottom edges of the multi-card element have been previously stitched, the multi-card element can be secured to the inner side of the flexible wall 13 by other suitable means, such as by gluing.

The multi-pocket billfold provided by the present invention is economically produced, requires less material for construction and is labor saving to manufacture.

What is claimed is:

1. A multi-card element for a wallet comprising a generally rectangular front wall having a width W and a generally rectangular back wall of the same width secured on at least their side edges to form an enclosure, said front wall having a plurality of parallel and spaced apart slits cut therein, said slits having a width of at least 90% of W, a pocket liner disposed within said enclosure, said pocket liner comprising an elongated generally rectangular back member having a width of from about 40% to about 90% of the width of said slits, said back member being secured at its top edge within said enclosure, and a plurality of generally rectangular, parallel and spaced apart card supporting members affixed at their lower edge to said back member, said card support members being spaced along said back member in a position such that the top edge of each respective card support member is in alignment with the bottom edge of a slit proceeding from top to bottom for each slit, respectively, the top edge of each card support member being affixed to the back of said front wall to define a series of card supporting chambers for the reception of cards, the bottom end of said back member being turned back on itself for a distance sufficient to form the bottom most one of said card support members.

2. A multi-card element in accordance with claim 1 wherein said pocket liner is centered along the length of said slit.

3. A multi-card element in accordance with claim 1 wherein the bottom most card support member defines the card supporting pocket for the penultimate slit and the bottom most pocket is defined by the last slit, said front wall and said back wall.

4. A multi-card element in accordance with claim 1 wherein said pocket liner has a width of at least 45% of W and wherein said pocket liner is secured between said front wall and said back wall of said enclosure on either the right or left side of said enclosure.

5. A multi-card element in accordance with claim 4 wherein said pocket liner has a width of from about 45% to about 75% of W.

6. A billfold having an inner and outer flexible wall secured together on three sides to form an envelope-like opening therein and having at least one of said multi-card elements of claim 1 affixed to said inner wall.

7. A billfold in accordance with claim 6 wherein said pocket liner is centered along the length of said slit.

8. A billfold in accordance with claim 6 wherein the bottom most card support member defines the card supporting pocket for the penultimate slit and the bottom most pocket is defined by the last slit, said front wall and said back wall.

9. A billfold in accordance with claim 6 wherein said pocket liner has a width of at least 45% of W and wherein said pocket liner is secured between said front wall and said back wall of said enclosure on either the right or left side of said enclosure.

10. A billfold in accordance with claim 9 wherein said pocket liner has a width of from about 45% to about 75% of W.

11. A fold-up type billfold having a single flexible wall and having at least one of said multi-card elements of claim 1 affixed to said wall.

12. A billfold in accordance with claim 11 wherein said pocket liner is centered along the length of said slit.

13. A billfold in accordance with claim 11 wherein the bottom most card support member defines the card supporting pocket for the penultimate slit and the bottom most pocket is defined by the last slit, said front wall and said back wall.

14. A billfold in accordance with claim 11 wherein said pocket liner has a width of at least 45% of W and wherein said pocket liner is secured between said front wall and said back wall of said enclosure on either the right or left side of said enclosure.

15. A billfold in accordance with claim 14 wherein said pocket liner has a width of from about 45% to about 75% of W.

* * * * *